US006390036B1

(12) United States Patent
Yuuki

(10) Patent No.: US 6,390,036 B1
(45) Date of Patent: May 21, 2002

(54) APPARATUS FOR CONTROLLING ELECTROMAGNETICALLY POWERED ENGINE VALVE

(75) Inventor: Kazuya Yuuki, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/632,592

(22) Filed: Aug. 4, 2000

(30) Foreign Application Priority Data

Aug. 19, 1999 (JP) ..... 11-233153

(51) Int. Cl.[7] ..... F01L 9/04
(52) U.S. Cl. ..... 123/90.11; 251/129.16
(58) Field of Search ..... 123/90.11, 90.12, 123/90.15; 251/129.1, 129.15, 129.16; 92/85 B, 85 R, 85 A, 143

(56) References Cited

U.S. PATENT DOCUMENTS

| | | | | |
|---|---|---|---|---|
| 5,269,269 A | * | 12/1993 | Kreuter | 123/90.11 |
| 5,769,043 A | * | 6/1998 | Nitkiewicz | 123/90.11 |
| 5,983,847 A | * | 11/1999 | Miyoshi | 123/90.11 |
| 6,024,059 A | | 2/2000 | Kamimaru et al. | 123/90.11 |
| 6,044,813 A | * | 4/2000 | Bulgatz | 123/90.11 |
| 6,082,315 A | * | 7/2000 | Schneider | 123/90.11 |

FOREIGN PATENT DOCUMENTS

| | | |
|---|---|---|
| JP | 7-335437 | 12/1995 |
| JP | 9-195736 | 7/1997 |
| JP | 11-182217 | 7/1999 |

OTHER PUBLICATIONS

English abstract of EP 0916814 A3, esp@cenet database—12.

* cited by examiner

*Primary Examiner*—Thomas Denion
*Assistant Examiner*—Jaime Corrigan
(74) *Attorney, Agent, or Firm*—Foley & Lardner

(57) ABSTRACT

In an electromagnetically powered engine valve control apparatus of an internal combustion engine having an electromagnetic actuator which drives the engine valve electromagnetically, and a valve-lift sensor which detecting a valve lift of the engine valve, a control unit operates the engine valve in a selected one of a normal operating mode enabling both powered opening and powered closing of the engine valve by energization of the electromagnetic actuator, and a free-fly operating mode enabling a kinetic system of the engine valve to be free to fly according to a damped vibration system by deenergization of the electromagnetic actuator. The control unit calculates a damping coefficient as a ratio of a valve lift detected during the free-fly operating mode to a valve lift detected during the normal operating mode, and also calculates a desired valve open period from a time when the engine valve starts to open to a time when the engine valve closes, based on engine speed. and engine load. A controlled current value of exciting current applied to the electromagnetic actuator is determined based on the damping coefficient and the desired valve open period.

25 Claims, 7 Drawing Sheets

Tcr MAP

| | | ENGINE SPEED N | | | | | |
|---|---|---|---|---|---|---|---|
| | | 1000 | · · · | 2000 | · · · | | 6000 |
| DESIRED ENGINE LOAD | 2 | | | | | | |
| | 4 | | | | | | |
| | ⋮ | | | | | | |

FIG.7

Ic MAP

| | | VALVE OPEN PERIOD To | | | | | |
|---|---|---|---|---|---|---|---|
| | | 5 | · · · | 20 | · · · | | 100 |
| DAMPING COEFFICIENT C | 1.0 | | | | | | |
| | 0.98 | | | | | | |
| | ⋮ | | | | | | |

FIG.8

K MAP

| | | ENGINE SPEED N | | | | | |
|---|---|---|---|---|---|---|---|
| | | 1000 | · · · | 2000 | · · · | | 6000 |
| DESIRED ENGINE LOAD | 2 | | | | | | |
| | 4 | | | | | | |
| | ⋮ | | | | | | |

APPARATUS FOR CONTROLLING ELECTROMAGNETICALLY POWERED ENGINE VALVE

BACKGROUND OF THE INVENTION

1. Field of the Invention

The present invention relates to an apparatus for controlling an electromagnetically powered valve operating device of an internal combustion engine capable of electromagnetically operating intake and exhaust valves, and specifically to technologies for accurately controlling a time length of valve opening of an electromagnetically powered engine valve (substantially corresponding to a time length from a time when the engine valve starts to open to a time when the engine valve reaches its fully opened position), in particular in presence of high frictional resistance to sliding motion of a kinetic system (containing at least a valve stem of the engine valve) under low-temperature engine operating conditions, for example with a cold engine in cold weather.

2. Description of the Prior Art

Generally, opening and closing of an engine valve (an intake-port valve or an exhaust-port valve) of an internal combustion engine are achieved by way of a typical cam-drive mechanism through which the rotational speed of an engine crankshaft is mechanically reduced. However, in case of the use of a cam-drive mechanism, it is difficult to optimally control or manage an engine valve open timing and/or an engine valve closure timing and to provide an optimal valve lift, depending on engine operating conditions. In order to solve this, in recent years, there have been proposed and developed various electromagnetically powered valve operating devices which are capable of operating intake and exhaust valves electromagnetically by way of an electromagnetic force created by an electromagnetic actuator instead of the use of a cam-drive mechanism. Such electromagnetically powered valve operating devices have been disclosed in Japanese Patent Provisional Publication Nos. 7-335437 and 9-195736. The electromagnetically powered valve operating device as disclosed in the Japanese Patent Provisional Publication Nos. 7-335437 and 9-195736, includes a disk-shaped armature, often called a "plunger", fixedly connected to the valve stem of an engine valve, a pair of electromagnets provided on opposite sides of the armature, and a pair of return springs biasing the armature toward a neutral position corresponding to a substantially middle position between the two opposing electromagnets. Opening and closing of the engine valve are achieved by attracting the armature alternately by the valve-opening side electromagnet and the valve-closing side electromagnet. An intake-valve closure timing (IVC), an intake-valve open timing (IVO), an exhaust-valve open timing (EVO), and an exhaust-valve closure timing (EVC) can be continually changed in response to command signals from an electronic control unit (ECU). When initiating powered opening of the engine valve, the ECU functions to move the armature from its end-of-displacement in the valve-closing direction (corresponding to a zero lift position) to its end-of-displacement in the valve-opening direction (corresponding to a maximum lift position), by breaking a holding current flowing through an electromagnetic coil of valve-closing side electromagnet and holding the armature at the end-of-displacement corresponding to the zero lift position and by applying an exciting current, often called a "catching current" to an electromagnetic coil of valve-opening side electromagnet. Application of holding current to the electromagnetic coil of valve-opening side electromagnet is continued during a valve open period. In contrast, when initiating powered closing of the engine valve, the ECU functions to move the armature from the end-of-displacement corresponding to the maximum lift position to the end-of-displacement corresponding to the zero lift position, by breaking the holding current flowing through the electromagnetic coil of valve-opening side electromagnet and by applying a catching current to the electromagnetic coil of valve-closing side electromagnet. Application of holding current to the electromagnetic coil of valve-closing side electromagnet is continued during a valve closing period.

SUMMARY OF THE INVENTION

However, the electromagnetically powered valve operating devices as disclosed in the Japanese Patent Provisional Publication Nos. 7-335437 and 9-195736, has the following drawback.

For instance, when attracting the armature by the electromagnet to initiate powered opening or closing of the engine valve, the armature would be attracted and moved to its end-of-displacement by application of catching current to the valve-opening side electromagnet or the valve-closing side electromagnet. In the presence of high frictional resistance to sliding motion of an engine-valve kinetic system (containing at least a valve stem) owing to a high coefficient of viscosity of engine oil at a very low-temperature engine operating condition, or owing to degraded engine oil, the sliding motion is unstable, and thus the valve open timing or valve closure timing, and the valve open period tend to fluctuate. This results in undesirable fluctuations in engine speed. The conventional electromagnetically powered valve operating device also suffers from the drawback that a current value of catching current applied to the electromagnet has to be increased in order to attain a full cycle of motion of the armature from one of the end-of-displacement corresponding to the zero lift position and the end-of-displacement corresponding to the maximum lift position to the other against such high frictional resistance to sliding motion. That is, there is a problem of increased electric power consumption.

Accordingly, it is an object of the invention to provide an apparatus for controlling an electromagnetically powered engine valve, which avoids the aforementioned disadvantages of the prior art.

It is another object of the invention to provide an apparatus for controlling an electromagnetically powered engine valve, which is capable of minimizing fluctuations in a valve open timing or closure timing of the engine valve, and fluctuations in a valve open period of the engine valve, that is, fluctuations in engine speed, even in presence of high frictional resistance to sliding motion of an engine-valve kinetic system containing at least a valve stem of the engine valve, owing to a high coefficient of viscosity of engine oil at very low-temperature engine operating conditions, or owing to degraded engine oil.

It is a further object of the invention to provide an apparatus for controlling an electromagnetically powered engine valve, which is capable of realizing an optimal valve open timing or closure timing of the engine valve, and an optimal valve open period without increasing electric power consumption.

In order to accomplish the aforementioned and other objects of the present invention, an apparatus for controlling electromagnetically powered engine valves, comprises an electromagnetic actuator driving an engine valve of an internal combustion engine electromagnetically, a valve-lift sensor detecting a valve lift of the engine valve, and a control unit which controls a controlled current value of exciting current applied to the electromagnetic actuator, based on the valve lift detected by the valve-lift sensor.

According to another aspect of the invention, an apparatus for controlling electromagnetically powered engine valves, comprises an electromagnetic actuating means for driving an engine valve of an internal combustion engine electromagnetically, a valve-lift detection means for detecting a valve lift of the engine valve, and a control means for controlling a controlled current value of exciting current applied to the electromagnetic actuating means, based on the valve lift detected by the valve-lift detection means, wherein the control means is configured to be electronically connected to the electromagnetic actuating means to operate the engine valve in a selected one of a normal operating mode enabling both powered opening and powered closing of the engine valve by energization of the electromagnetic actuating means, and a free-fly operating mode enabling a kinetic system of the engine valve to be free to fly according to a damped vibration system by deenergization of the electromagnetic actuating means.

According to a further aspect of the invention, a method of controlling an electromagnetically powered engine valve of an internal combustion engine having an electromagnetic actuator driving the engine valve electromagnetically, and a valve-lift sensor detecting a valve lift of the engine valve, the method comprising operating the engine valve in a selected one of a normal operating mode enabling both powered opening and powered closing of the engine valve by energization of the electromagnetic actuator, and a free-fly operating mode enabling a kinetic system of the engine valve to be free to fly according to a damped vibration system by deenergization of the electromagnetic actuator, calculating a damping coefficient as a ratio of a valve lift detected by the valve-lift sensor during the free-fly operating mode to a valve lift detected by the valve-lift sensor during the normal operating mode, calculating a desired valve open period from a time when the engine valve starts to open to a time when the engine valve closes, based on engine speed and engine load, and controlling a controlled current value of exciting current applied to the electromagnetic actuator based on the damping coefficient and the desired valve open period.

BRIEF DESCRIPTION OF THE DRAWINGS

FIG. 7 shows an example of a look-up table (a characteristic map) indicative of the relationship among the valve open period To, the damping coefficient C, and a set current value Ic of catching current.

FIG. 8 shows an example of a look-up table (a characteristic map) indicative of the relationship among engine speed N, desired engine load, and a load correction factor K.

FIG. 9A is a time chart briefly explaining a modification of the electromagnetically powered engine valve control apparatus, and showing valve-lift characteristics, namely a valve-opening delay time Td, a valve-opening time length Tcr, and a fluctuation in the valve open period To.

DESCRIPTION OF THE PREFERRED EMBODIMENTS

Figure 1:
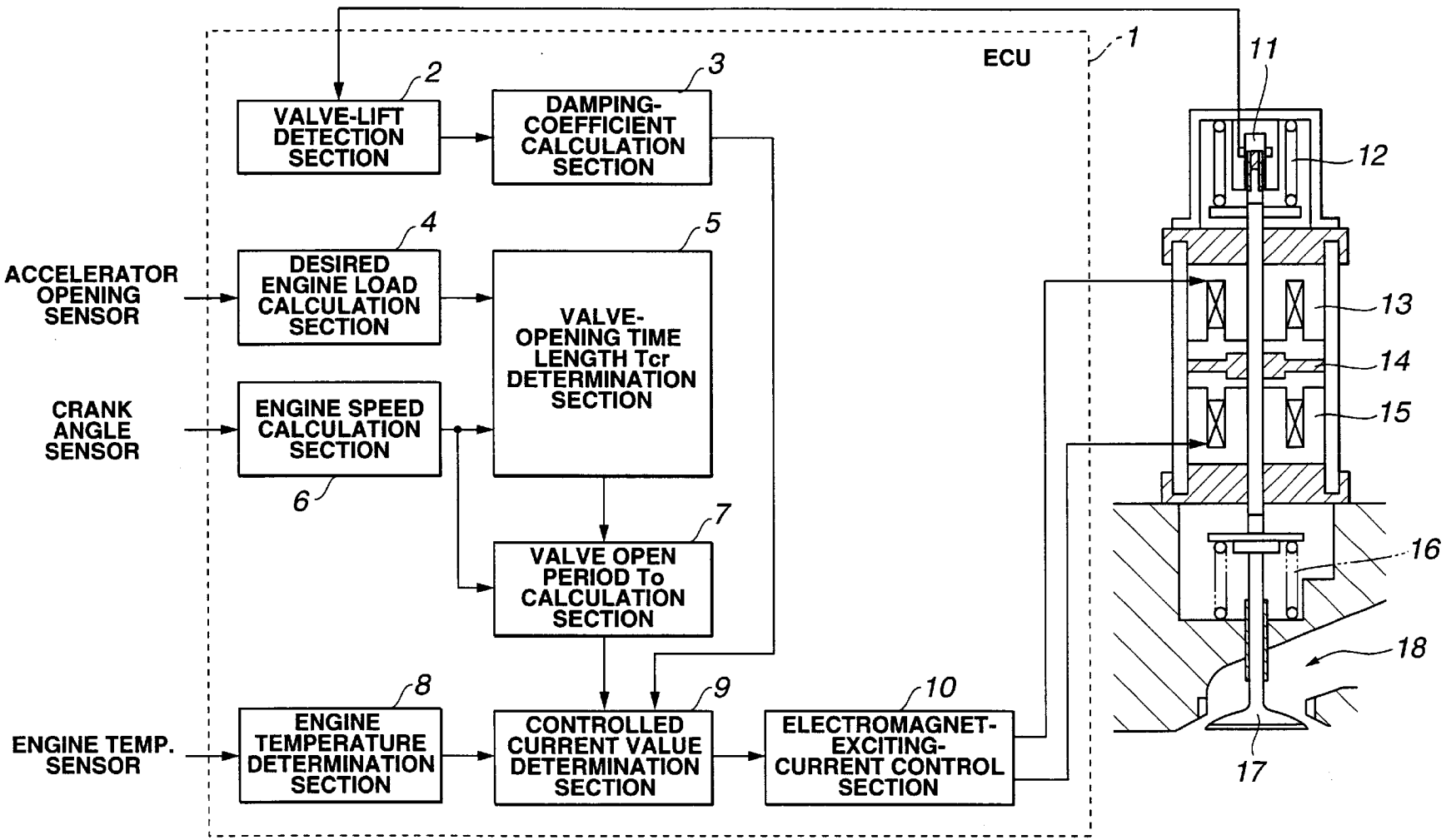
FIG. 1 is a system diagram illustrating a system arrangement of one embodiment of an apparatus for controlling an electromagnetically powered engine valve of the invention.

Referring now to the drawings, particularly to FIG. 1, the electromagnetically powered engine valve control apparatus of the invention is exemplified in a four-stroke-cycle internal combustion engine equipped with electromagnetically powered engine valves (electromagnetically powered intake and exhaust valves). Each of the engine valves includes an engine valve 17 opening and closing an engine-valve port 18, a valve-opening side electromagnet 13, a valve-closing side electromagnet 15, a movable armature or plunger 14 made of magnetic substance and movable between the two opposing electromagnets 13 and 15, a valve-lift sensor 11, an upper return spring (upper coiled valve spring) 12 permanently biasing movable armature 14 (engine valve 17) in a direction closing the engine valve, and a lower coiled valve spring 16 permanently biasing engine valve 17 in a direction opening the engine valve. As seen from the system diagram shown in FIG. 1, opening and closing of electromagnetically powered engine valve 17 are electronically controlled by means of an electronic engine control unit (ECU) 1. Engine control unit 1 includes a valve-lift detection section 2, a damping-coefficient (C) calculation section 3, a desired engine load calculation section 4, a valve-opening time length (Tcr) determination section 5, an engine speed (N) calculation section 6, a valve open period (To) calculation section 7, an engine temperature (T) determination section 8, a controlled current value to determination section 9, and an electromagnet-exciting-current control section 10. Valve-lift detection section 2 is provided to monitor or detect a valve lift based on a signal from valve-lift sensor 11. Damping-coefficient calculation section 3 is provided to calculate a damping coefficient C (which will be fully described later).

Desired engine load calculation section 4 (simply, engine load calculation section) is provided to calculate a desired engine load based on an accelerator opening (an amount of depression of the accelerator). The accelerator opening is usually sensed by an accelerator opening sensor, such as an accelerator position sensor (not numbered). Valve-opening time length determination section 5 is provided to determine a desired valve-opening time length Tcr (simply, a valve-opening time length) substantially corresponding to an angular displacement (expressed in terms of degrees) of an engine crankshaft from a time when the engine valve starts to open to a time when the engine valve reaches its fully opened position) on the basis of both engine speed and desired engine load. Engine speed calculation section 6 is provided to calculate engine speed N based on a signal from a crankshaft position sensor or a crank angle sensor (not numbered). Valve open period (To) calculation section 7 calculates a desired valve open period (simply, a valve open period) To from a time when the engine valve starts to open to a time when the engine valve closes, on the basis of both the engine speed N and valve-opening time length Tcr. Engine temperature determination section 8 is provided to determine engine temperature based on engine coolant temperature sensed by a coolant temperature sensor (a water temperature sensor) or based on lubricating oil temperature sensed by an oil temperature sensor (an engine oil temperature sensor or a transmission oil temperature sensor). Controlled current value determination section 9 is provided to determine both a controlled current value of exciting current applied to electromagnet 13 and a controlled current value of exciting current applied to electromagnet 15, on the basis of valve open period To and damping coefficient C. Electromagnet-exciting-current control section 10 is provided to drive an electromagnetic coil of electromagnet 13 by application of an exciting current corresponding to the controlled current value for electromagnet 13, and to drive an electromagnetic coil of electromagnet 15 by application of an exciting current corresponding to the controlled current value for electromagnet 15.

Figures 5, 6:
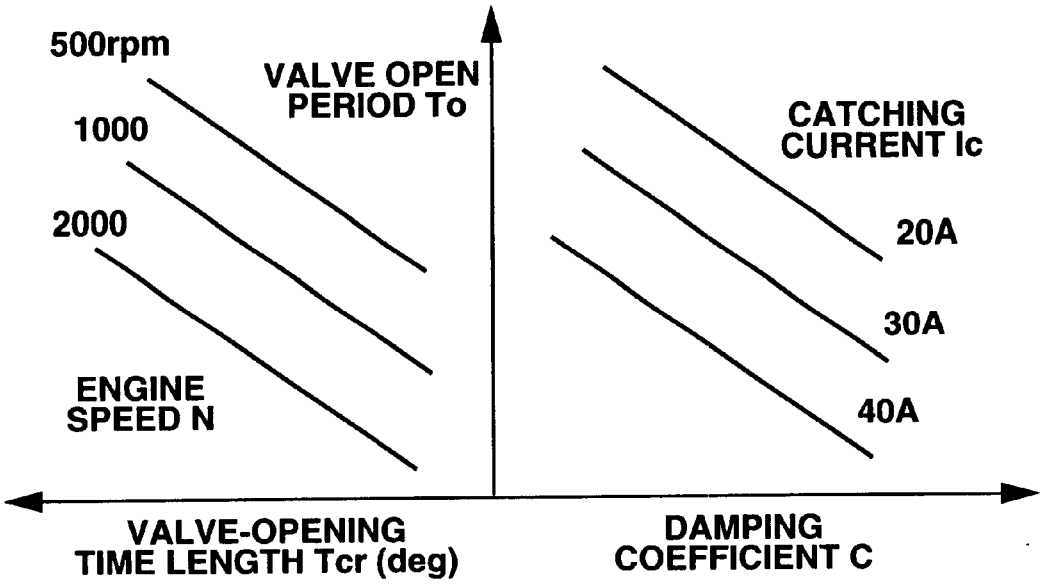
FIG. 5 is a graph illustrating the relationship among a damping coefficient C, a valve open period To, and a valve-opening time length Tcr.
FIG. 6 shows an example of a look-up table (a characteristic map) indicative of the relationship among engine speed N, desired engine load, and a valve-opening time length Tcr.

In calculating damping coefficient C within damping-coefficient calculation section 3, assuming that a valve lift of engine valve 17, obtained during a "free-fly" valve operating mode (which will be fully described later), is denoted by La, and a valve lift of the same engine valve, obtained during a normal valve operating mode (which will be fully described later), is denoted by Lf, a ratio (La/Lf) of valve lift La obtained during the "free-fly valve operating mode" to valve lift Lf obtained during the normal valve operating mode is calculated as damping coefficient C. In order for valve-opening time length determination section 5 to determine valve-opening time length Tcr based on engine speed and desired engine load, the valve-opening time length determination section pre-stores a preprogrammed valve-opening time length (Tcr) characteristic map or a preprogrammed Tcr look-up table shown in FIG. 6 showing how a valve-opening time length (Tcr) has to be varied relative to two different parameters, namely engine speed and desired engine load. In the apparatus of the shown embodiment, valve-opening time length Tcr is determined by way of map-retrieval based on both engine speed and desired engine load from the preprogrammed Tcr map. Actually, the valve-opening time length indicative values $f(x_0, y_0), f(x_1, y_1), \ldots, f(x_n, y_n)$ of a certain function f are known for particular engine speed values $x_0, x_1, \ldots, x_n$, and particular engine load values $y, y_1, \ldots y_n$, in the form of map data, accounting for a limited memory capacity of memories incorporated in ECU 1. In order to find an approximation for f(x, y), for a given engine speed value of x, somewhere between these particular engine speed values, and for a given engine load value of y, somewhere between these particular engine load values, an interpolation process is used. Valve open period calculation section 7 calculates valve open period To based on both engine speed N and valve-opening time length Tcr, from the following expression (1).

$$To=60\times1000\times Tcr/360\times N \quad (1)$$

where To denotes a valve open period (unit: msec) from a time when the engine valve starts to open to a time when the engine valve closes, Tcr denotes a valve-opening time length (unit: degrees) substantially corresponding to an angular displacement of engine crankshaft from a time when the engine valve starts to open to a time when the engine valve reaches its fully opened position, and N denotes engine speed (unit: rpm). In order for controlled-current value determination section 9 to determine both the controlled current value of exciting current applied to electromagnet 13 and the controlled current value of exciting current applied to electromagnet 15, based on valve open period To and damping coefficient C, controlled current value determination section 9 pre-stores a preprogrammed controlled current value (Ic) characteristic map or a preprogrammed set catching-current value (Ic) look-up table shown in FIG. 7 showing how a controlled current value (a set catching-current value) has to be varied relative to two different parameters, namely a valve open period To and a damping coefficient C. In the apparatus of the shown embodiment, controlled current value Ic (catching current value) is determined by way of map-retrieval based on both valve open period To and damping coefficient C from the preprogrammed Ic map. Actually, the controlled-current-value indicative values $f(To_0, C_0), f(To_1, C_1), \ldots, f(To_n, C_n)$ of a certain function f are known for particular valve open period values $To_0, To_1, \ldots, To_n$, and particular damping coefficient values $C_0, C_1, \ldots, C_n$, in the form of map data, accounting for a limited memory capacity of memories incorporated in ECU 1. In order to find an approximation for f(To, C), for a given valve open period value of To, somewhere between these particular valve open period values, and for a given damping coefficient value of C, somewhere between these particular damping coefficient values, an "interpolation" process is used.

Figure 2:
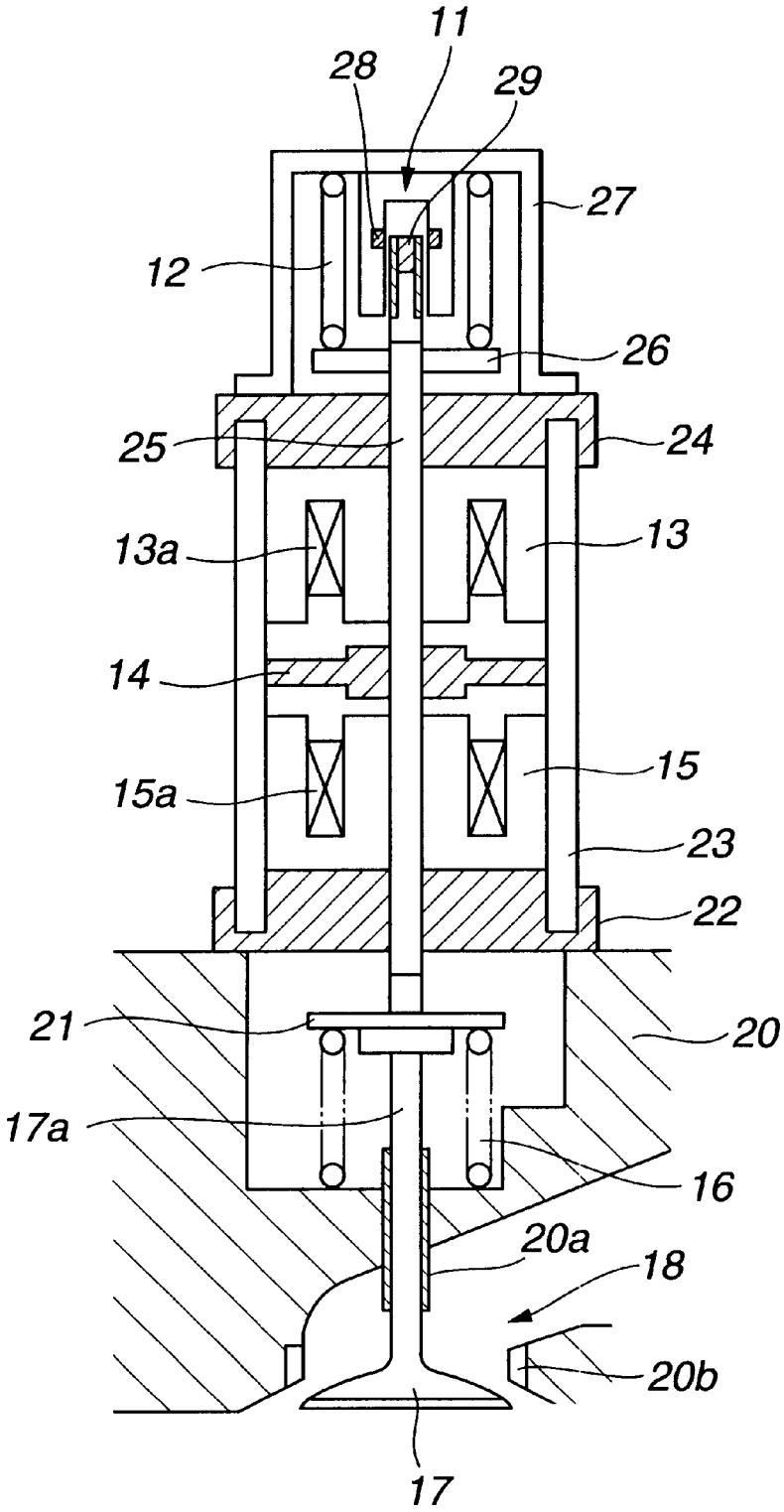
FIG. 2 is a longitudinal cross section illustrating a detailed structure of the electromagnetically powered engine valve unit.

Referring now to FIG. 2, there is shown the detailed structure of the electromagnetically powered engine valve unit. In addition to the basic component parts, that is, valve-lift sensor 11, upper coiled valve spring 12, electromagnet pair (13, 15), movable armature 14, lower coiled valve spring 16, and engine valve 17, the electromagnetically powered engine valve unit also includes a valve retainer 21, three-split housings 22, 23, and 24, an axially movable rod 25, a spring seat 26, and a spring cover 27. An electromagnetic valve actuator is comprised of at least an axially-movable plunger (consisting of movable armature 14 and rod 25), upper and lower valve springs 12 and 16, upper and lower electromagnetic coils 13*a* and 15*a*, and upper and lower electromagnets 13 and 15. Movable rod 25 is provided to support movable armature 14 in a manner such that the armature is axially movable between the two opposing electromagnets 13 and 15. Valve stem 17*a* of engine valve 17 is slidably fitted into a cylindrical valve guide 20*a* tightly fitted into a bore formed in cylinder head 20, so that the valve stem is slidable up and down by way of the valve guide. Valve retainer 21 is fixedly connected to the tip of valve stem 17*a*. Valve spring 16 is disposed between valve retainer 21 and cylinder head 20 under preload imposed thereon. For this reason, engine valve 17 is permanently biased in a direction closing engine-valve port 18 of the cylinder head. Three-split housings 22,23, and 24 are fixedly mounted on the cylinder head. Electromagnets 13 and 15 are accommodated in the internal space defined in the three-split housings (22, 23, 24). Valve-closing side electromagnet 13 is fixedly connected directly to upper housing 24, whereas valve-opening side electromagnet 15 is fixedly connected directly to lower housing 22. Upper electromagnetic coil 13*a* is disposed in the annular recessed portion formed in upper magnet 13, while lower electromagnetic coil 15*a* is disposed in the annular recessed portion formed in lower magnet 15. As can be appreciated from an upper-coil power line interconnecting the output port of electromagnet-exciting-current control section 10 and upper coil 13*a* (see FIG. 1), an exciting current (driving current) is applied via a driver circuit of current control section 10 to coil 13*a* of upper electromagnet 13 so as to attract movable armature 14 toward the lower attracting face of upper magnet 13. In contrast, as can be appreciated from a lower-coil power line interconnecting the output port of electromagnet-exciting-current control section 10 and lower coil 15*a*, an exciting current (driving current) is applied via a driver circuit of current control section 10 to coil 15*a* of lower electromagnet 15 so as to attract movable armature 14 toward the upper attracting face of lower magnet 15. Movable rod 25 is coaxially aligned with valve stem 17*a* and connected to the upper end portion of the valve stem. The movable rod is axially slidably fitted into axial central bores of two opposing magnets 13 and 15 and upper and lower housings 24 and 22 integrally connected with the cylindrical housing 23. Movable armature 14 is constructed as a disk-shaped member fixed to the middle portion of movable rod 25. More accurately, the movable armature is made of soft magnetic substance. Upper spring seat 26 is fixed to the upper end of movable rod 25. Upper coiled valve spring 12 is disposed between upper spring seat 26 and an upper wall portion of the spring cover 27, in order to permanently bias movable rod 25 in a direction opening the engine valve. As previously described, valve stem 17*a* and movable rod 25 are coaxially aligned with each other. Therefore, when movable rod 25 is forced in the direction opening the engine valve, that is, downwards (viewing FIG. 2), the valve stem is pushed down by movable rod 25, thereby causing the engine valve to open. Conversely, when movable rod 25 is forced in the direction closing the engine valve, that is, upwards (viewing FIG. 2), the valve stem is pushed up by movable rod 25, and thereby the engine valve moves in the direction closing the engine valve until engine-valve port 18 is closed with abutment between engine valve 17 and valve seat 20*b*. Concerning a kinetic system of engine valve 17 (containing at least movable armature 14, engine valve 17, valve stem 17*a*, and rod 25), when upper and lower electromagnetic coils 13*a* and 15*a* of electromagnets 13 and 15 are de-energized, the kinetic system of engine valve 17 (particularly, the movable armature) is held its neutral position (equilibrium position) spaced apart from the lower attracting face of upper electromagnet 13 and the upper attracting face of lower electromagnet 15, respective predetermined distances by means of spring bias (spring force) of spring 12 and spring bias of spring 16. During initial engine startup period, electromagnet-exciting-current control section 10 alternately excites electromagnets 13 and 15, so as to resonate the movable armature. With the lapse of time, the amplitude of resonance of movable armature 14 tends to increase. At the last stage of the engine-starting period, the movable armature is attracted by the lower attracting face of valve-closing side electromagnet 13, for instance, and then held in such an attracted state for a brief moment. Valve-lift sensor 11 is also located at the tip of movable rod 25 for monitoring or detecting an axial displacement of movable rod 25 (actual valve lift or actual valve lifting height of engine valve 17). In the apparatus of the embodiment, this valve-lift sensor 11 is comprised of a permanent magnet 29 attached onto or fixedly connected to the tip of movable rod 25, and a Hall element 28 fixedly connected to the inner peripheral wall of spring cover 27. The Hall element 28 serves as a magnetism-to-electricity converter. Permanent magnet 29 is movable up and down together with movable rod 25. When the permanent magnet is brought closer to Hall element 28, the resulting magnetic field creates a voltage in the Hall element. That is to say, the voltage is induced in the Hall element. In this manner, a relative position of movable rod 25 to spring cover 27, that is, a valve lift of the engine valve is monitored or detected in the form of voltage in the Hall element by detecting a change in flux of magnetic induction, created owing to axial movement of permanent magnet 29 brought close to Hall element 28. As mentioned above, the above magnetic valve-lift sensor is designed to detect a valve lift by monitoring a change in magnetic flux, and thus it is possible to realize a reliable high-precision valve-lift detection, even in dusty circumstances. In lieu of the use of a Hall-effect valve-lift sensor (a magnetic lift sensor), an optical valve-lift sensor may be used. The optical valve-lift sensor uses a light emitting diode (LED) or a laser diode. First, light is emitted from the LED or laser diode to the movable armature. Then, the relative position of the movable armature can be indirectly detected by measuring an angle (or a position) of incidence of light reflected from movable armature 14. In comparison with a Hall-effect valve-lift sensor (a magnetic lift sensor), an optical valve-lift sensor previously discussed is useful to reliably measure or detect a valve lift of the engine valve in presence of electromagnetic interference or electromagnetic disturbance that causes undesirable response in electronic equipment.

Figure 3A:
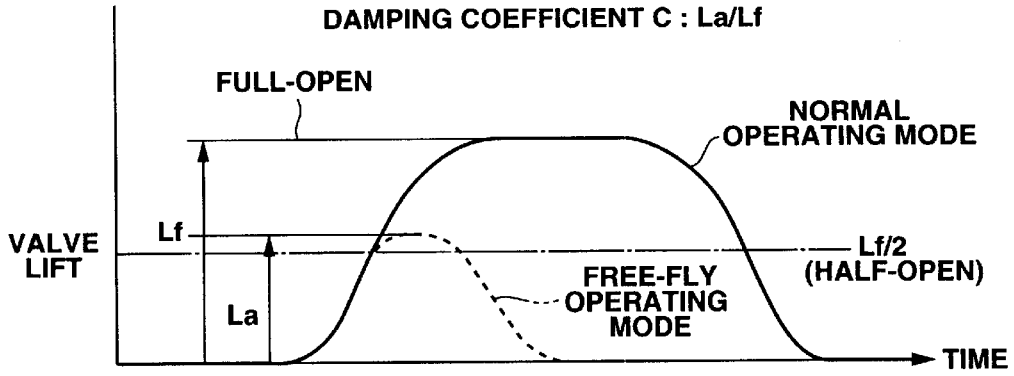
FIG. 3A is a time chart for comparison between a valve-lift characteristic obtained in a normal engine-valve operating mode and a valve-lift characteristic obtained in a so-called "free-fly" valve operating mode.
Figure 3B:
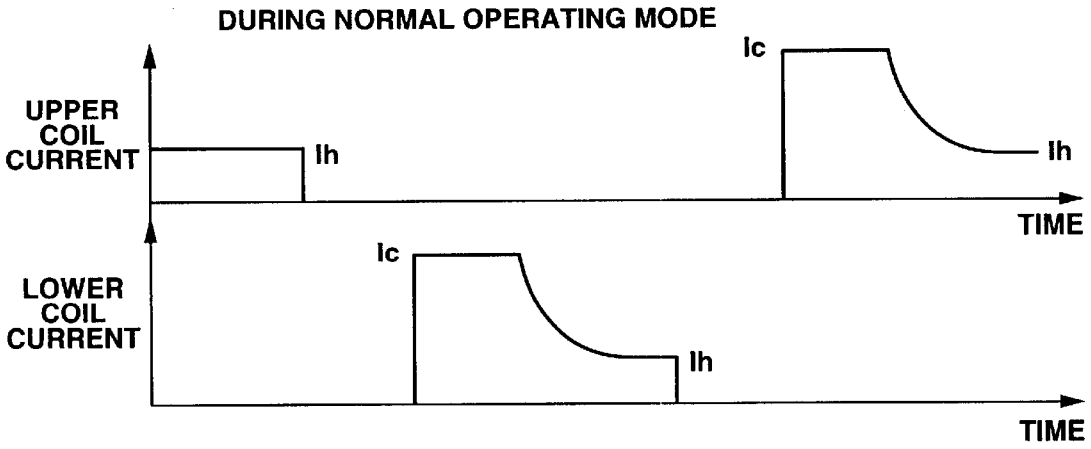
FIG. 3B is a time chart showing waveforms of exciting currents (Ih, Ic) applied to upper and lower electromagnetic coils of the electromagnetically powered engine valve, during the normal valve operating mode.
Figure 3C:
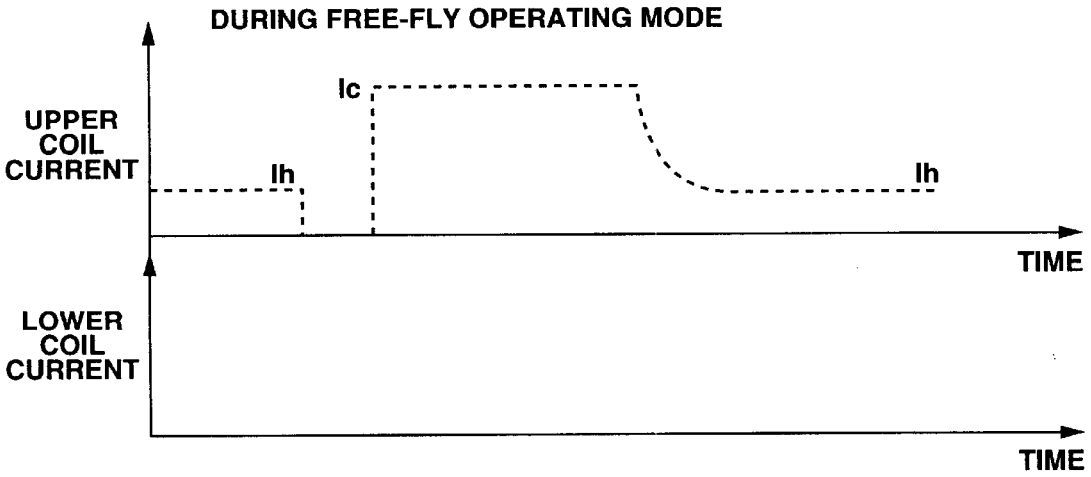
FIG. 3C is a time chart showing waveforms of exciting currents (Ih, Ic) applied to the upper and lower electromagnetic coils, during the "free-fly" valve operating mode.

The normal valve operating mode and the "free-fly" valve operating mode are fully described hereunder in reference to the time charts shown in FIGS. 3A, 3B and 3C.

The solid line of FIG. 3A indicates a valve-lift characteristic curve obtained in the normal engine-valve operating mode. Also, the upper time chart of FIG. 3B indicates a waveform of exciting current applied to electromagnet 13 (upper coil) during the normal valve operating mode, while the lower time chart of FIG. 3B indicates a waveform of exciting current applied to electromagnet 15 (lower coil) during the normal valve operating mode. As seen from the characteristic curve indicated by the solid line in FIG. 3A and the current waveform of FIG. 3B, when engine valve 17 must be opened, holding current Ih flowing through the electromagnetic coil of valve-closing side electromagnet 13 is broken (see the trailing edge of the left-hand side current waveform of the upper time chart of FIG. 3B). Thus, the movable armature starts to move downward by way of spring bias of springs 12 and 16. At this time, movable armature 14 moves toward the upper attracting face of valve-opening side electromagnet 15, but it is impossible to move the movable armature to a position corresponding to the fully opened position of the engine valve, owing to energy loss such as frictional resistance. In the normal valve operating mode, when the movable armature is brought close to the upper attracting face of electromagnet 15 and thus reaches a position that an electromagnetic force created by lower electromagnet 15 can be effectively exerted on the movable armature, a catching current lo is applied to the electromagnetic coil of electromagnet 15 (see the leading edge of the current waveform of the lower time chart of FIG. 3B). By virtue of an attracting force created by electromagnet 15, movable armature 14 is attracted by the lower electromagnet. In this manner, during the normal operating mode (or normal drive mode), engine valve 17 is shifted or displaced to its fully opened position with the aid of the attracting force of lower electromagnet 15. In FIG. 3A, the valve lift denoted by Lf corresponds to a valve lift of the engine-valve fully-opened state. Conversely, when engine valve 17 must be closed, holding current Ih flowing through the electromagnetic coil of valve-opening side electromagnet 15 is first broken (see the trailing edge of the current waveform of the lower time chart of FIG. 3B). As seen from the waveform of the lower time chart of FIG. 3B, during transition from powered opening to powered closing of engine valve 17, the exciting current applied to lower coil 15*a* rapidly rises up to a catching current value Ic, and remains at catching current value Ic for a brief moment, and gradually falls along a quadratic curve down to holding current value Ih, and thereafter holding current Ih is rapidly shut off. As compared to the catching current value (Ic), holding current (Ih) is set at a relatively low current value necessary to hold the armature 14 at its attracted state, to avoid wasteful electric energy consumption. After holding current Ih flowing through the electromagnetic coil of electromagnet 15 is broken for the powered closing of engine valve 17, the kinetic system of engine vale 17 (containing at least movable armature 14, engine valve 17, valve stem 17*a*, and rod 25) passes through the neutral position once by spring bias of springs 12 and 16. Then, the kinetic system of engine valve 17 approaches to the lower attracting face of valve-closing side electromagnet 13, and thus reaches a position that an electromagnetic force created by upper electromagnet 13 can be effectively exerted on the movable armature. At this time, a catching current Ic is applied to the electromagnetic coil of electromagnet 13 (see the leading edge of the right-hand side current waveform of the upper time chart of FIG. 3B). By virtue of an attracting force created by electromagnet 13, the movable armature is attracted toward the lower attracting face of upper electromagnet 13. In this manner, during the normal operating mode, with the assistance of the attracting force of upper electromagnet 13, engine valve 17 is shifted or displaced to its fully closed position at which engine valve 17 is in abutted-contact with valve seat 20*c*. As discussed above, during the normal operating mode, it is possible to move or displace the movable armature a predetermined axial displacement (valve lift Lf substantially corresponding to the fully opened position of engine valve 17) by alternately exciting or energizing two opposing electromagnets 13 and 15. That is, the normal operating mode means a mode in which switching between the full-open state and the fully-closed state of engine valve 17 occurs with the assistance of the attracting forces created by upper and lower electromagnets 13 and 15 alternately energized.

The broken line of FIG. 3A indicates a valve-lift characteristic curve obtained in the "free-fly" valve operating mode. Also, the upper time chart of FIG. 3C indicates a waveform of exciting current applied to electromagnet 13 (upper coil) during the "free-fly" operating mode. As seen from the lower time chart of FIG. 3C, note that there is no exciting current applied to electromagnet 15 (lower coil) during the "free-fly" operating mode. Under the fully-closed state wherein movable armature 14 is attracted by valve-closing side electromagnet 13 (upper coil) and the engine valve is held at its fully closed position, when holding current Ih flowing through the electromagnetic coil of electromagnet 13 is broken (see the trailing edge of the left-hand side current waveform of the upper time chart of FIG. 3C), the movable armature starts to move downward from the uppermost position that the movable armature is attracted by electromagnet 13, by way of spring bias of springs 12 and 16. That is, engine valve 17 starts to lift. The motion of the kinetic system of engine valve 17 (without any attracting force created by electromagnet 15) after shutoff of holding current Ih applied to the electromagnetic coil of electromagnet 13, is expressed as a waveform of damped vibration of a damped vibration system defined by the mass of a kinetic system of engine valve 17 containing at least movable armature 14, engine valve 17, valve stem 17*a*, and rod 25, the combined spring stiffness of springs 12 and 16, and the coefficient of friction of the kinetic system of engine valve 17. When the motion of movable armature 14 is maintained by the restoring forces only as per the damped vibration system, the damped vibration or the damped motion is generally said to be a "free-fly". Also, the "free-fly" operating mode (or "free-fly" drive mode) means a valve operating mode in which the movable armature is free to fly in the internal space defined between the two opposing attracting faces of electromagnets 13 and 15 in accordance with the previously-noted damped vibration system, until the upper coil is energized again at the last stage of the "free-fly" operating mode and then the armature is caught by the lower attracting face of valve-closing side electromagnet 13. Note that, during the "free-fly" operating mode, switching between the substantially half-open state and the fully-closed state of engine valve 17 occurs with the aid of the attracting force created by only the upper electromagnet intermittently energized. The coefficient of friction of the kinetic system of engine valve 17 is dependent upon various factors, for example engine oil temperature, coefficient of viscosity of engine oil, degree of contamination of engine oil, and degree of degradation of engine oil. As can be appreciated from the upper-half time chart of FIG. 3C, during the "free-fly" valve operating mode, when a catching current Ic is applied to the electromagnetic coil of electromagnet 13 at a proper timing without applying any exciting current to the electromagnetic coil of electromagnet 15, after holding current Ih flowing through the electromagnetic coil of electromagnet 13 is shut off, movable armature 14 is attracted again by valve-closing side electromagnet 13. As seen from the valve-lift characteristic curve indicated by the broken line of FIG. 3A, in the shown embodiment valve lift La obtained during the "free-fly" operating mode is substantially one-half (Lf/2) of valve lift Lf obtained during the normal operating mode. As appreciated, valve lifting height (valve lift) La obtained during the "free-fly" operating mode or the maximum axial displacement of the kinetic system of engine valve 17 from its position of equilibrium (often called the amplitude of the damped vibration system) is different depending on the magnitude of friction loss of the electromagnetically powered valve operating system of each of intake and exhaust valves. According to the control apparatus of the embodiment, during the "free-fly" operating mode, engine valve 17 moves toward a substantially half-open position by way of shutoff of holding current Ih applied to the upper coil of electromagnet 13, and then returns from the substantially half-open position to the fully closed position by way of application of catching current Ic to the same upper coil of electromagnet 13. As described above, during the "free-fly" operating mode, there is no excitation of the lower coil of electromagnet 15. This ensures wasteful electric power consumption. Damping-coefficient calculation section 3 of ECU 1 calculates damping coefficient C as a ratio (La/Lf) of valve lift La obtained during the "free-fly operating mode" to valve lift Lf obtained during the normal operating mode. In other words, the damping coefficient is represented by an expression C=La/Lf. As appreciated, the damping coefficient constructs a measure of the magnitude of friction loss of the electromagnetically powered valve operating system of each of intake and exhaust valves. That is to say, the greater the damping coefficient C, the smaller the friction loss of the electromagnetically powered valve operating system. For example, when the frictional resistance (or friction loss) is "0", damping coefficient C becomes "1". The damping coefficient tends to reduce, as the friction of the valve operating system increases.

Referring to FIG. 5, the right-hand half of FIG. 5 shows the relationship among catching current Ic, damping coefficient C, and valve open period To, whereas the left-hand half of FIG. 5 shows the relationship among engine speed N, valve-opening time length Tcr, and valve open period To. As appreciated from the right-hand half of FIG. 5, when catching current Ic to be applied to the electromagnet is maintained constant, the greater the damping coefficient C, the shorter the valve open period To. Additionally, valve open period To reduces, as catching current Ic increases. As appreciated from the left-hand half of FIG. 5, when engine speed N is maintained constant, valve-opening time length Tcr is in direct-proportional relationship with valve open period To. On the other hand, when valve-opening time length Tcr is kept constant, engine speed N and valve open period To are in inverse-proportion to each other.

Figure 4:
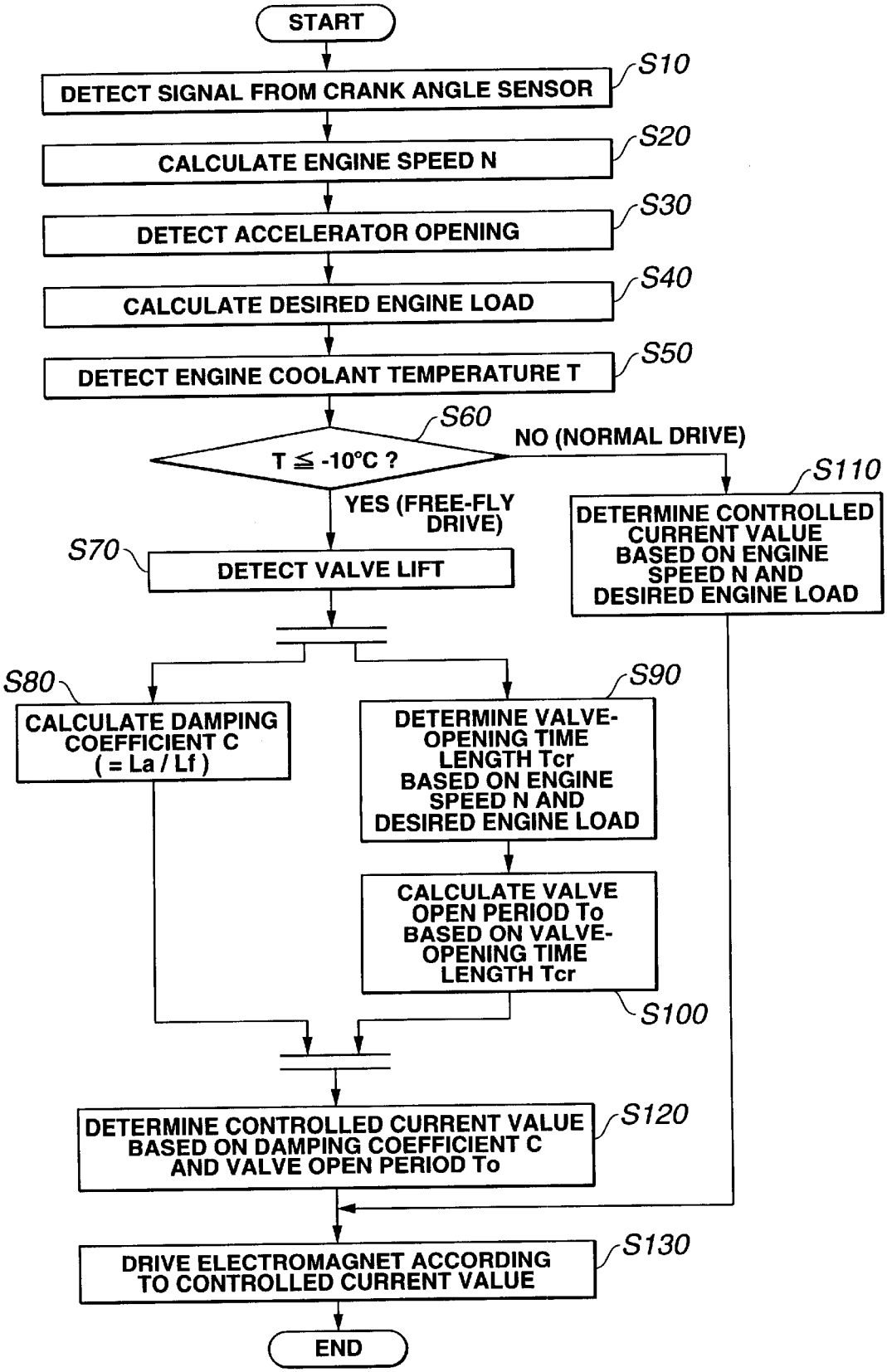
FIG. 4 is a flow chart showing a control routine (main program) of the electromagnetically powered engine valve control apparatus of the embodiment.

Referring to FIG. 4, there is shown the main program executed by ECU 1 of the electromagnetically powered engine valve control apparatus of the embodiment.

At step S10, a signal from the crank angle sensor is detected. At step S20, engine speed N is computed or calculated based on the signal from the crank angle sensor.

At step S30, a signal from the accelerator opening sensor (accelerator position sensor) is detected. At step S40, a desired engine load is calculated based on the signal indicative of accelerator opening. At step S50, engine coolant temperature T is detected as engine temperature. At step S60, a check is made to determine whether engine coolant temperature T detected is below a predetermined temperature value such as −10° C. When the answer to step S60 is in the negative (NO), that is, T>−10° C., the ECU of the control apparatus determines that the engine has already been warmed up or the engine starts up at a sufficiently high operating temperature. Thus, the routine proceeds from step S60 to step S110, so as to execute the normal operating mode (normal drive mode) in which movable armature 14 is driven between a first end-of-displacement corresponding to the zero lift position and a second end-of-displacement corresponding to the maximum lift position (full-open position of valve lift Lf) by alternately exciting upper and lower coils of electromagnets 13 and 15, and thus a full cycle of motion of the kinetic system of engine valve 17 is completed. Concretely, at step S110, a controlled current value of exciting current to be applied to each of upper and lower electromagnets 13 and 15 is calculated based on both engine speed and desired engine load. Actually, the controlled current value is map-retrieved from a preprogrammed characteristic map showing how the controlled current value has to be varied relative to engine speed and desired engine load. Thereafter, the routine flows from step S110 to step S130 (described later). In contrast to the above, when the answer to step S60 is in the affirmative (YES), that is, T≦−10° C., the ECU of the control apparatus determines that the engine is in low engine operating conditions. Thus, the routine proceeds from step S60 to step S70, so as to execute the free operating mode "free-fly" drive mode) in which movable armature 14 is driven between the first end-of-displacement corresponding to the zero lift position and a third position of a comparatively small valve lift La substantially corresponding to a substantially half-open position (Lf/2) of engine valve 17 by timely intermittently exciting only the upper coil of electromagnet 13. At step S70, a valve lift La is detected. At step S80, a damping coefficient C is calculated as a ratio La/Lf of valve lift La obtained during the "free-fly" drive mode to valve lift Lf obtained during the normal drive mode. Then, at step S90, valve-opening time length Tcr is determined or retrieved based on engine speed N and desired engine load from a preprogrammed characteristic map of FIG. 6 showing how a valve-opening time length Tcr has to be varied relative to engine speed N and desired engine load. At step S100, valve open period To is arithmetically calculated based on more recent data of engine speed N and valve-opening time length Tcr (determined through step S90) from the previously-noted expression (1). After this, at step S120, the controlled current value is determined or computed based on both damping coefficient C (see step S80) and valve open period To (see S100) from a preprogrammed characteristic map of FIG. 7 showing how a controlled current value (a set catching current value Ic) has to be varied relative to damping coefficient C and valve open period To. Then, at step S130, the coil of each of electromagnets 13 and 15 is driven by application of exciting current substantially corresponding to the controlled current value.

With the previously-described arrangement, in case that the frictional resistance to sliding motion of the kinetic system (containing at least movable armature 14, engine valve 17, valve stem 17, and rod 25) unstably fluctuates and is comparatively great owing to a high coefficient of viscosity of engine oil during cold engine operating conditions at low engine temperatures, the control apparatus of the embodiment functions to calculate a damping coefficient C based on two different valve lifts La and Lf detected, and then to determine a controlled current value (Ic) of exciting current to be applied to electromagnetic coil (13, 15) on the basis of damping coefficient C and desired valve open period To. Thus, it is possible to accurately control or manage the electromagnetically powered engine valve to the desired valve open period at the minimum of electric power consumption. That is, according to the apparatus of the embodiment, a controlled current value (a driving current value) of exciting current applied to each of the electromagnetically powered intake and exhaust valves can be properly controlled depending on the valve lift detected by the valve-lift sensor. Thus, it is possible to realize a desired engine valve open timing and/or a desired engine valve closure timing, even in presence of a change in coefficient of viscosity of engine oil and a change in frictional loss owing to degraded engine oil, a change in atmospheric temperature, and/or a change in environmental condition. Additionally, in the apparatus of the embodiment, the engine valve (intake and/or exhaust valves) is operated in the free-fly operating mode, in presence of high frictional resistance (high friction loss in the valve operating system) to sliding motion of the kinetic system of the engine valve owing to a high coefficient of viscosity of engine oil at very low-temperature engine operating conditions. The free-fly operating mode is effective to shorten a time period required to open and close the engine valve, thus reducing electric power consumption and current capacity of the electromagnetic actuator.

Additionally, in the apparatus of the embodiment, the desired valve-opening time length Tcr and the controlled current value (electromagnetic actuator driving current) Ic are map-retrieved from respective preprogrammed characteristic maps. Such map-retrieval is effective to shorten a time necessary to derive or compute the controlled current value. This enhances a speed of response to a change in frictional resistance to sliding motion of the kinetic system of the engine valve.

In the apparatus of the embodiment, in order to calculate a damping coefficient C, valve-lift sensor 11 is provided for each of electromagnetically powered intake and exhaust valves. In lieu of the provision of the valve-lift sensor for the electromagnetically powered exhaust valve, the controlled current value of the exhaust valve side may be estimated or computed based on the signal from valve-lift sensor 11 for the intake valve side, by utilizing a predetermined characteristic map or a preprogrammed lookup table as shown in FIG. 8. The preprogrammed lookup table of FIG. 8 shows how a load correction factor K has to be varied relative to engine speed N and desired engine load. In this case, a controlled current value for the intake valve side, is first determined according to the flow from step S10 through steps S20–S100 to S120. Thereafter, a controlled current value of the exhaust valve side can be estimated or calculated by multiplying load correction factor K (retrieved from the K map of FIG. 8) with the controlled current value for the intake valve side. As discussed above, by storing the K map within the memory (ROM) of ECU 1, a valve-lift sensor for the exhaust valve side can be eliminated, thus simplifying an electromagnetically powered engine valve of the exhaust valve side, and also reducing total production costs of the electromagnetically powered valve operating system.

Figure 9A:
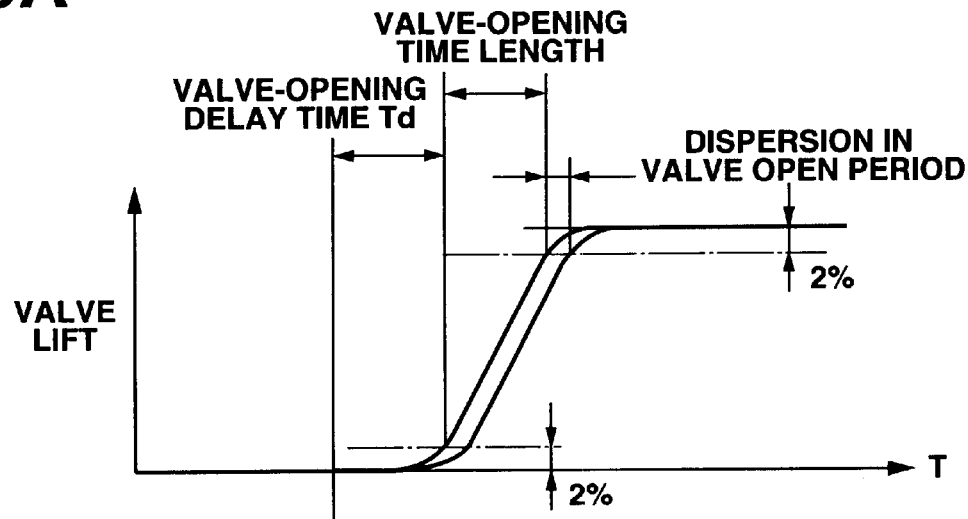
Figure 9B:
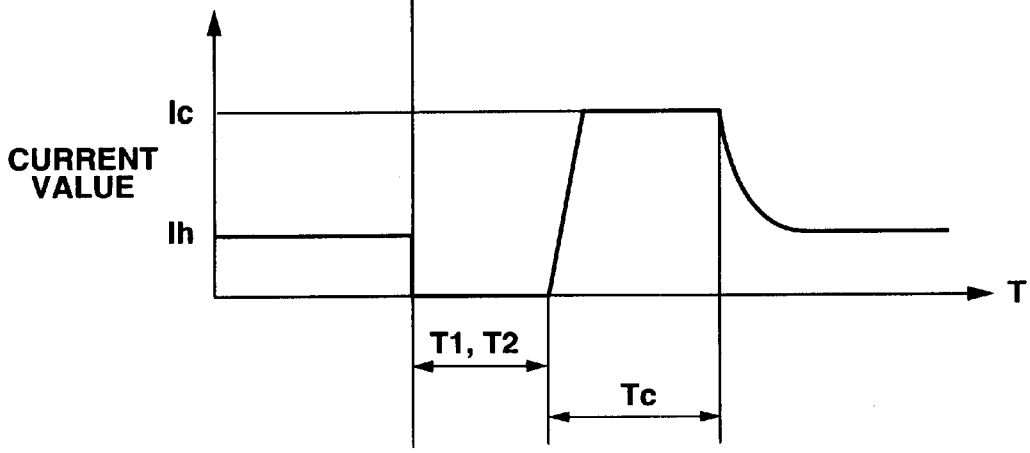
FIG. 9B is a time chart briefly explaining the electromagnetically powered engine valve control apparatus of the modification, and showing waveforms of exciting currents (Ih, Ic) applied to the upper and lower electromagnetic coils, and showing the relationship among a time interval T1 from a time when the valve closing side electromagnet (upper coil) is de-energized (off) to a time when the valve-opening side electromagnet (lower coil) is energized (on), a time interval T2 from a time when the valve-opening side electromagnet (lower coil) is de-energized to a time when the valve-closing side electromagnet (upper coil) is energized, a time interval To of application of catching current Ic, and a holding current value Ih.

As set forth above, in the control apparatus of the embodiment, the controlled current value of exciting current (catching current Ic) applied to each of upper and lower exciting coils of electromagnets 13 and 15 is controlled based on damping coefficient C. That is, the controlled current value is used as a controlled variable. Instead thereof, as shown in FIGS. 9A and 9B, the time interval T1 from a time when valve-closing side electromagnet 13 (upper coil 13*a*) is de-energized (off) to a time when valve-opening side electromagnet 15 (lower coil 15*a*) is energized (on), the time interval T2 from a time when valve-opening side electromagnet 15 (lower coil 15*a*) is de-energized to a time when valve-closing side electromagnet 13 (upper coil 13*a*) is energized, the time interval Tc of application of catching current Ic, and/or the holding current value Ih may be used as controlled variables, and thus properly controlled based on the damping coefficient C.

The entire contents of Japanese Patent Application No. P11-233153 (filed Aug. 19, 1999) is incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A control apparatus for a valve in an engine, comprising:

an electromagnetic actuator comprising a spring biasing a kinetic system aligned with the valve and an electromagnet that attracts the kinetic system to open and close the valve; and a control unit configured to:

calculate a damping coefficient of the kinetic system obtained during a free-fly operation accompanied with deenergization of the electromagnet; and calculate a current value of exciting current to be applied to the electromagnetic actuator in accordance with the damping coefficient.

2. The control apparatus as claimed in claim 1, wherein the damping coefficient is calculated as a ratio of a valve lift obtained during the free-fly operation to a valve lift obtained during a normal operation accompanied with energization of the electromagnet.

3. The control apparatus as claimed in claim 1, further comprising a valve lift sensor detecting a valve lift, and wherein the damping coefficient is calculated as a ratio of the valve lift obtained during the free-fly operation to the valve lift obtained during a normal operation accompanied with energization of the electromagnet.

4. The control apparatus as claimed in claim 3, wherein the valve lift sensor is a Hall-effect valve lift sensor.

5. The control apparatus as claimed in claim 3, wherein the valve lift sensor is an optical valve lift sensor.

6. The control apparatus as claimed in claim 1, wherein the control unit is further configured to calculate a desired valve open period in time, and wherein the current value of exciting current applied to the electromagnetic actuator is calculated in accordance with the damping coefficient and the desired valve open period.

7. The control apparatus as claimed in claim 6, wherein the control unit is further configured to calculate a desired valve opening length in degree based on an engine speed and an engine load, and wherein the desired valve open period in time is calculated based on the desired valve opening length in degree and the engine speed.

8. The control apparatus as claimed in claim 6, wherein the control unit is further configured to pre-store a table showing the current value of exciting current applied to the electromagnetic actuator relative to the damping coefficient and the desired valve open period in time, and wherein the current value of exciting current applied to the electromagnetic actuator is looked up from the table.

9. The control apparatus as claimed in claim 1, wherein the control unit is further configured to determine whether an engine temperature is below a predetermined temperature value or not, and wherein the current value of exciting current applied to the electromagnetic actuator is calculated in accordance with the damping coefficient when the engine temperature is below the predetermined temperature value.

10. The control apparatus as claimed in claim 1, wherein the valve is an intake valve of the engine.

11. The control apparatus as claimed in claim 10, further comprising an electromagnetic actuator opening and closing an exhaust valve of the engine, which includes a spring biasing a kinetic system aligned with the exhaust valve and an electromagnet attracting the kinetic system to open and close the exhaust valve, wherein the control unit calculates a current value of exciting current to be applied to the electromagnetic actuator of the exhaust valve based on the calculated current value of exciting current applied to the electromagnetic actuator of the intake valve.

12. The control apparatus as claimed in claim 11, further comprising a valve lift sensor detecting a valve lift, and wherein the current value of exciting current applied to the electromagnetic actuator of the intake valve is calculated by using the detected valve lift of the valve lift sensor.

13. The control apparatus as claimed in claim 11, wherein the current value of exciting current applied to the electromagnetic actuator of the exhaust valve is calculated by modifying the current value of exciting current applied to the electromagnetic actuator of the intake valve with a correction factor.

14. The control apparatus as claimed in claim 13, wherein the correction factor is derived in accordance with an engine speed and an engine load.

15. The control apparatus as claimed in claim 1, wherein the valve is an exhaust valve of the engine.

16. The control apparatus as claimed in claim 1, wherein the electromagnetic actuator comprises a pair of electromagnets, an armature aligned with the valve and a pair of springs biasing the valve in opposite directions respectively, and wherein the armature is arranged to be movable between the electromagnets so as to open and close the valve by alternately energizing the electromagnets.

17. An apparatus for controlling electromagnetically powered engine valves, comprising:

an electromagnetic actuating means for driving an engine valve of an internal combustion engine electromagnetically;

a valve-lift detection means for detecting a valve lift of the engine valve;

a control means for controlling a controlled current value of exciting current applied to said electromagnetic actuating means, based on the valve lift detected by said valve-lift detection means;

said control means being configured to be electronically connected to said electromagnetic actuating means to operate the engine valve in a selected one of (A) a normal operating mode enabling both powered opening and powered closing of the engine valve by energization of said electromagnetic actuating means, and (B) a free-fly operating mode enabling a kinetic system of the engine valve to be free to fly according to a damped vibration system by deenergization of said electromagnetic actuating means; and said control means calculating a damping coefficient as a ratio of a valve lift detected by said valve-lift detection means during the free-fly operating mode to a valve lift detected by said valve-lift detection means during the normal operating mode, and calculates a desired valve open period from a time when the engine valve starts to open to a time when the engine valve closes, based on engine speed and engine load, and controls the controlled current value based on the damping coefficient and the desired valve open period.

18. An apparatus for controlling electromagnetically powered engine valves, comprising:

an electromagnetic actuator driving an engine valve of an internal combustion engine electromagnetically;

a valve-lift sensor detecting a valve lift of the engine valve;

a control unit that controls a controlled current value of exciting current applied to said electromagnetic actuator, based on the valve lift detected by said valve-lift sensor;

said control unit being configured to be electronically connected to said electromagnetic actuator to operate the engine valve in a selected one of (A) a normal operating mode enabling both powered opening and powered closing of the engine valve by energization of said electromagnetic actuator, and (B) a free-fly operating mode enabling a kinetic system of the engine valve to be free to fly according to a damped vibration system by deenergization of said electromagnetic actuator; and said electromagnetic actuator comprising at least a movable armature constructing part of the kinetic system of the engine valve, a pair of electromagnets, a movable rod supporting the movable armature so that the armature is axially movable between the electromagnets, and a pair of valve springs biasing the engine valve in opposing axial directions, and wherein said control unit drives the engine valve between a first end-of-displacement corresponding to a zero lift position and a second end-of-displacement corresponding to a maximum lift position by alternately energizing the electromagnets during the normal operating mode, and drives the engine valve between the first end-of-displacement and a third end-of-displacement substantially corresponding to a substantially middle position between the zero lift position and the maximum lift position by intermittently energizing only one of the electromagnets acting to attract the armature in a direction closing the engine valve.

19. An apparatus for controlling electromagnetically powered engine valves, comprising:

an electromagnetic actuator driving an engine valve of an internal combustion engine electromagnetically;

a valve-lift sensor detecting a valve lift of the engine valve;

a control unit that controls a controlled current value of exciting current applied to said electromagnetic actuator, based on the valve lift detected by said valve-lift sensor; and said control unit being configured to be electronically connected to said electromagnetic actuator to operate the engine valve in a selected one of (A) a normal operating mode enabling both powered opening and powered closing of the engine valve by energization of said electromagnetic actuator, and (B) a free-fly operating mode enabling a kinetic system of the engine valve to be free to fly according to a damped vibration system by deenergization of said electromagnetic actuator; said normal operating mode being a mode that the kinetic system of the engine valve is driven between a first end-of-displacement corresponding to a zero lift position and a second end-of-displacement corresponding to a maximum lift position by energizing said electromagnetic actuator so that the kinetic system is attracted in a first axial direction opening the engine valve during the powered opening and attracted in a second axial direction closing the engine valve during the powered closing, and said free-fly operating mode being a mode that the kinetic system is driven between the first end-of-displacement and a third end-of-displacement substantially corresponding to a substantially middle position between the zero lift position and the maximum lift position by energizing said electromagnetic actuator so that the kinetic system is attracted in the second axial direction only during the powered closing.

20. The apparatus as claimed in claim 19, wherein said control unit calculates a damping coefficient as a ratio of a valve lift detected by said valve-lift sensor during the free-fly operating mode to a valve lift detected by said valve-lift sensor during the normal operating mode, and calculates a desired valve open period from a time when the engine valve starts to open to a time when the engine valve closes, based on engine speed and engine load, and controls the controlled current value based on the damping coefficient and the desired valve open period.

21. The apparatus as claimed in claim 20, wherein said control unit pre-stores a first characteristic map showing how a desired valve-opening time length has to be varied relative to engine speed and engine load, the desired valve-opening time length being substantially corresponding to an angular displacement of an engine crankshaft from a time when the engine valve starts to open to a time when the engine valve reaches a fully opened position, and pre-stores a second characteristic map showing how the desired valve open period has to be varied relative to the desired valve-opening time length, and a third characteristic map showing how the controlled current value has to be varied relative to the damping coefficient and the desired valve open period.

22. The apparatus as claimed in claim 21, wherein the engine valves comprises an electromagnetically powered intake valve and an electromagnetically powered exhaust valve, and said valve-lift sensor detects only a valve lift of the intake valve, and said control unit prestores a fourth characteristic map for a correction factor which is preprogrammed to be suitable to calculate a first controlled current value used to drive the exhaust valve from a second controlled current value used to drive the intake valve, and calculates the second controlled current value based on at least a damping coefficient calculated as a ratio of a valve lift of the intake valve detected by said valve-lift sensor during the free-fly operating mode to a valve lift of the intake valve detected by said valve-lift sensor during the normal operating mode, and calculates the first controlled current value by multiplying the second controlled current value by the correction factor.

23. The apparatus as claimed in claim 22, wherein the fourth characteristic map is preprogrammed to show how the correction factor has to be varied relative to engine speed and engine load.

24. A method of controlling an electromagnetically powered engine valve of an internal combustion engine having an electromagnetic actuator driving the engine valve electromagnetically, and a valve-lift sensor detecting a valve lift of the engine valve, the method comprising;

operating the engine valve in a selected one of (A) a normal operating mode enabling both powered opening and powered closing of the engine valve by energization of said electromagnetic actuator, and (B) a free-fly operating mode enabling a kinetic system of the engine valve to be free to fly according to a damped vibration system by deenergization of said electromagnetic actuator;

calculating a damping coefficient as a ratio of a valve lift detected by said valve-lift sensor during the free-fly operating mode to a valve lift detected by said valve-lift sensor during the normal operating mode;

calculating a desired valve open period from a time when the engine valve starts to open to a time when the engine valve closes, based on engine speed and engine load; and controlling a controlled current value of exciting current applied to said electromagnetic actuator based on the damping coefficient and the desired valve open period.

25. The method as claimed in claim 24, which comprises attracting the kinetic system alternately in opposing axial directions of the engine valve by energizing said electromagnetic actuator once during powered opening in the normal operating mode and by energizing said electromagnetic actuator once during powered closing in the normal operating mode, and attracting the kinetic system in a direction closing the engine valve by energizing said electromagnetic actuator once only during powered closing in the free-fly operating mode.

* * * * *